US005964438A

United States Patent [19]

Camilleri

[11] Patent Number: 5,964,438

[45] **Date of Patent: *Oct. 12, 1999**

[54] WALL-MOUNTED STORAGE UNIT SYSTEM

[76] Inventor: Charles Camilleri, 5900 Holyoke Dr., St. Louis, Mo. 63123

[ * ] Notice: This patent is subject to a terminal disclaimer.

[21] Appl. No.: 08/352,573

[22] Filed: Dec. 9, 1994

[51] Int. Cl.[6] ..... E04G 5/06

[52] U.S. Cl. ..... 248/225.2; 248/323; 248/339; 248/340

[58] Field of Search ..... 52/36.4, 36.5, 52/36.6; 211/94, 103, 187; 246/225.2, 224.2, 222.2, 323, 339, 340

[56] References Cited

U.S. PATENT DOCUMENTS 5,050,832 9/1991 Lee et al. ..... 248/225.2
5,222,611 6/1993 Wood et al. ..... 211/94

*Primary Examiner*—Carl D. Friedman
*Assistant Examiner*—Yvonne Horton-Richardson
*Attorney, Agent, or Firm*—Baker & McKenzie

[57] ABSTRACT

An improved wall-mounted storage unit system which uses a reversible mounting bracket and which places the majority of the unit's gravitational stress upon the bracket itself, rather than on the interlocking edges of the panel or rail members. A rail member having a small, upwardly protruding lip is mounted to a wall. The mounting bracket is then affixed within a cutout section of a vertical side panel in either of two desirable reversed positions such that the bracket may be attached to the mounting rail and the rear edge of the panel able to be placed flush against the wall. An adjacent panel may then be mounted using the same type of bracket. At no point does the vertical panel itself ever engage the mounting rail. Means are then provided to permanently secure the bracket and panel to the rail and to adjust the vertical height of a panel, if necessary, after it is attached to the mounting rail.

4 Claims, 4 Drawing Sheets

7
24
53
1
12
24
31
35
44
32
21
3
15
40
30
44
32
31
58
26
35
2

7
27
56
53
1
12
24
31
44
3
15
29
21
40
30
44
29
24
58
31
2

WALL-MOUNTED STORAGE UNIT SYSTEM

The present invention relates generally to modular storage units which are mounted upon a wall and, more specifically, to a simplified system of constructing such storage units wherein the number of primary installation steps are reduced to (1) securing a horizontal mounting rail to a wall, (2) attaching a reversible mounting bracket within a cutout section of a side panel of the storage unit, (3) mounting the bracket to the mounting rail such that the side panel is perpendicular from, and suspended from, the vertical wall, and (4) adjusting the vertical height of the panel and permanently securing it in place.

BACKGROUND OF THE INVENTION

In recent years, this field of art has seen a tremendous growth in the area of "modular-type" storage unit systems. Such modularity typically affords the installer the flexibility to create a customized storage unit which best takes advantage of the available storage space in a particular area. Most of these systems are designed around such basic components as wall mounting rails, vertical panels, horizontal shelves and rods, and various mounting brackets by which to secure a final assembly. Storage unit systems which fall into this category are disclosed, for example, in U.S. Pat. Nos. 4,403,761; 4,457,436; 4,928,833; 5,050,832; and 5,222,611.

There are, however, a variety of disadvantages associated with one or more of the above-noted designs. First of all, some designs prove to have weak interlocking features whereby undue gravitational stress is applied to a mounting rail and/or vertical panel member. Second of all, there are limitations associated with certain of such designs whereby a customized storage unit cannot be constructed so as to be completely flush with either a wall, floor or ceiling. Lastly, many of these designs still include a veritable grocery list of parts and/or involve detailed and cumbersome assembly procedures whereby the installation of a unit must be performed by more than one person, parts must be juggled during installation, and panel components must be held in position as their corresponding mounting brackets are secured in place.

SUMMARY OF THE INVENTION

To overcome these and other problems associated with the existing styles of modular storage unit systems, the present invention contemplates a wall-mounted unit simply constructed of three basic components—a mounting rail, vertical side panels and reversible mounting brackets.

According to the preferred procedure, a mounting rail is secured to a wall in a substantially horizontal position. Next, a mounting bracket is temporarily attached to a rear edge of a vertical panel within a pre-formed cutout section which accommodates the external dimensions of the mounting rail. As the mounting rail and mounting bracket have complementary contours, the bracket (and attached panel) may then be placed over the mounting rail to form a single side panel of a storage unit which extends perpendicularly from the wall. The bracket is then permanently secured to the mounting rail. If the panel is in the proper vertical position with respect to the rail, the mounting bracket is then permanently secured to the panel. Alternatively, if the panel is not in the correct vertical position, the panel may be temporarily loosened from the bracket and, if necessary, adjusted upwards to the desired vertical position wherein it may then be permanently secured to the bracket.

Specifically, the mounting rail is a substantially horizontal piece which has a small, upwardly formed lip capable of engaging the complementarily-formed and uniquely-designed mounting bracket. The mounting bracket itself is "reversible" in that it may be mounted in either of two desired reversed positions upon a panel. That is, the top and bottom halves of the bracket are mirror images of each other and each one has a mounting hook member. Since the mounting bracket also has a panel flange member which is positioned flat against one side of a panel, brackets on adjacent panels may be reversely mounted to allow their respective panel flanges to face toward one another; i.e. "inward." The brackets are temporarily secured to the panels by inserting mounting screws through oval slots in the panel flanges.

The mounting hook members are positioned entirely within the cutout section on the rear edge of a side panel, do not take up any usable storage space on the sides of the panels, and are specifically designed to engage the upwardly formed lip of the mounting rail. Once engaged, the back edge of the panel is kept flush against the wall and the panel itself extends perpendicularly from the wall. Not only are the hook members of the bracket substantially hidden from view, but their placement within the cutout section of the panel also relieves the notched edges of the panel from having to bear the weight of the entire unit.

The mounting bracket also has a small rail flange member which lays flat against the face of the rail once the bracket engages the rail's upwardly formed lip. Two holes are provided within this rail flange member to allow for the permanent attachment of the bracket to the rail with additional mounting screws. Holes must be drilled in the proper locations to accommodate these screws.

Furthermore, the present invention also allows each side panel to be adjusted slightly in its own vertical plane whereby the installer first loosens the screws in the panel flange member which are temporarily securing the bracket to the panel, adjusts the panel to the desired position, and then permanently secures the panel to the bracket by inserting two additional mounting screws through two round mounting holes in the panel flange member. Holes must be drilled in the proper locations to accommodate these screws as well.

It is therefore a general object of the present invention to provide a modular wall-mounted storage unit system having a minimum amount of assembly components.

It is a further object of the present invention to simplify the installation of such a storage unit through the use of but a single configuration of mounting bracket.

In addition, it is an object of the present invention to provide a design whereby the mounting brackets are substantially hidden from view in the final installed unit.

Another object of the present invention is to provide a storage unit system whereby gravitational stress is substantially borne by one or more mounting brackets, and not by the interlocking edges of the panel and rail members.

A further important object of this invention is to provide a wall-mounted storage unit system which is relatively simple to construct yet very sturdy and secure once in place.

Yet another object of the present invention is to further simplify the installation of such a storage unit by eliminating a step which requires that a panel component first be lifted and held in position as its associated mounting bracket is subsequently secured in place upon a mounting rail.

Moreover, it is an object of the present invention to allow for the quick and easy vertical adjustment of its vertical panels to ensure the proper horizontal leveling of the structure as a whole.

Further objects and advantages of the invention will become apparent to those of ordinary skill in the pertinent art upon review of the following detailed description, accompanying drawing, and appended claims.

BRIEF DESCRIPTION OF THE DRAWING

The invention is illustrated more or less diagrammatically in the accompanying drawing wherein.

Figure 1:
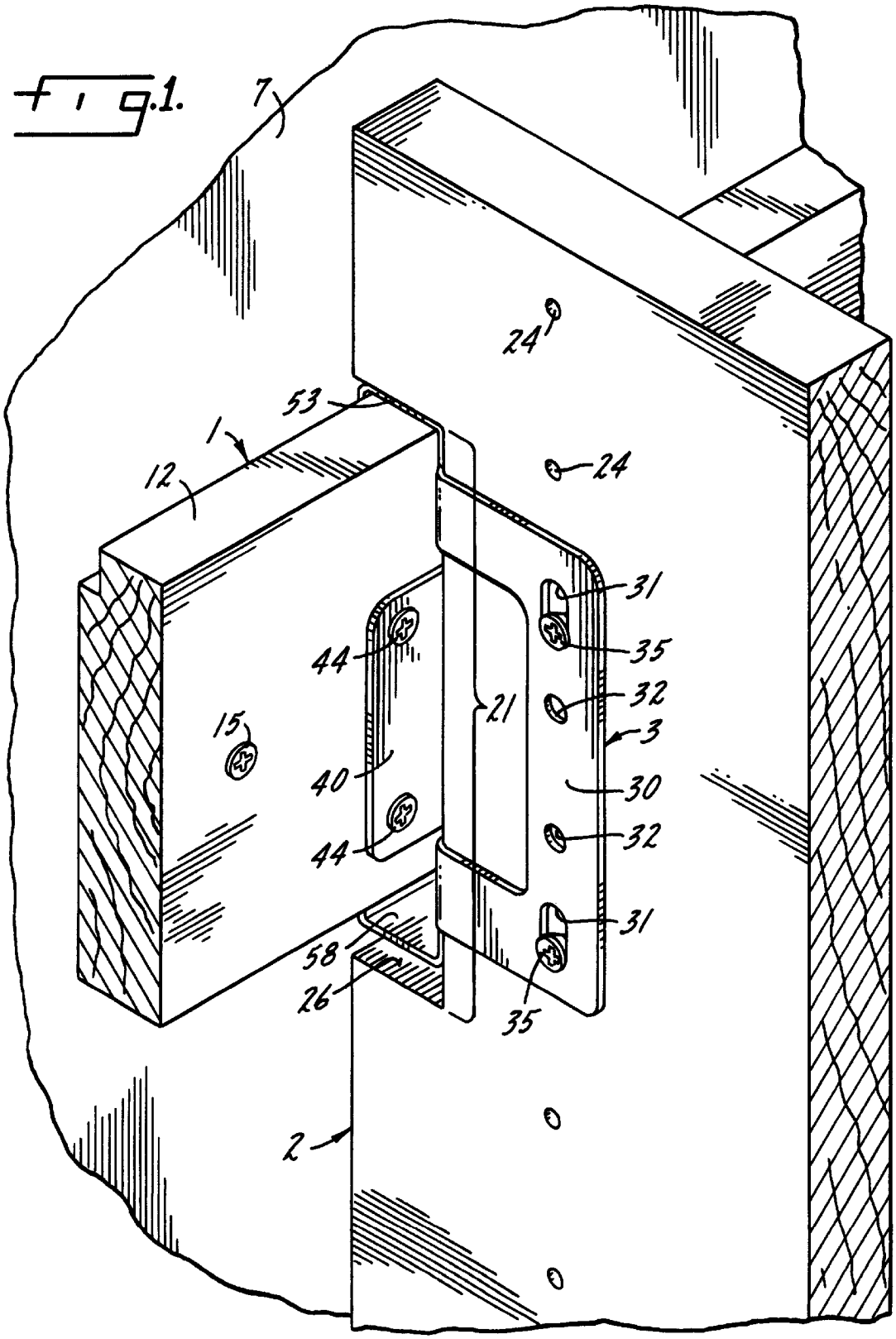
FIG. 1 is a three-dimensional perspective view of the wall-mounted storage unit system of the present invention before any vertical adjustments have been made to the vertical side panel.

Notice must be taken that the drawings are not necessarily to scale and that the embodiments are sometimes illustrated by phantom lines and diagrammatic representations. In certain instances, details which are not necessary for an understanding of the present invention but which render other details difficult to perceive may have been omitted. It should be understood, of course, that the invention is not necessarily limited to the particular embodiments illustrated herein.

DETAILED DESCRIPTION OF THE DRAWING

Turning first to FIG. 1, the primary components of the wall-mounted storage unit system are shown in an initially assembled position and include a mounting rail 1, a vertical side panel 2 and a mounting bracket 3. The invention is assembled by first securing the mounting rail 1 in a substantially horizontal position upon a wall 7 using rail screws 15 wherein the rail's ledge segment 12 is pointing upwards. The installer then positions the mounting bracket 3 such that its upper hook 53 and lower hook 58 are within cutout section 21 of the vertical side panel 2 and upper hook 53 is also in contacting relation with the upper edge of the cutout section 21. This positioning ensures that the panel flange 30 is placed flat against the side of the panel 2, and that a small lower gap 26 is retained between lower hook 58 and the lower edge of the cutout section 21. The bracket 3 is then temporarily attached to the panel 2 by inserting mounting screws 35 through the oval mounting slots 31 and into mounting holes 24.

The next installation step merely requires that the combination of the panel 2 and newly-attached bracket 3 be placed over the mounting rail 1 and gradually lowered until the upper hook 53 directly engages the wall facing side of ledge segment 12 whereby the panel 2 is perpendicularly suspended from the wall 7 and the rail flange 40 is held flush against the face of the mounting rail 1. It must be noted that at no time do the interior edges of the cutout section 21 ever directly engage the supporting surface area of the mounting rail 1. Indeed, the bracket 3 is a structural, weight-transmitting member which isolates the panel 2 from direct weight transferring relationship with the mounting rail 1. The bracket 3 is then permanently secured to the mounting rail 1 by inserting mounting screws 44 through pre-formed holes in the rail flange 40 and into the mounting rail 1. It may be necessary for the installer to drill two small holes in the mounting rail 1 to facilitate the insertion of these mounting screws 44.

Figure 2:
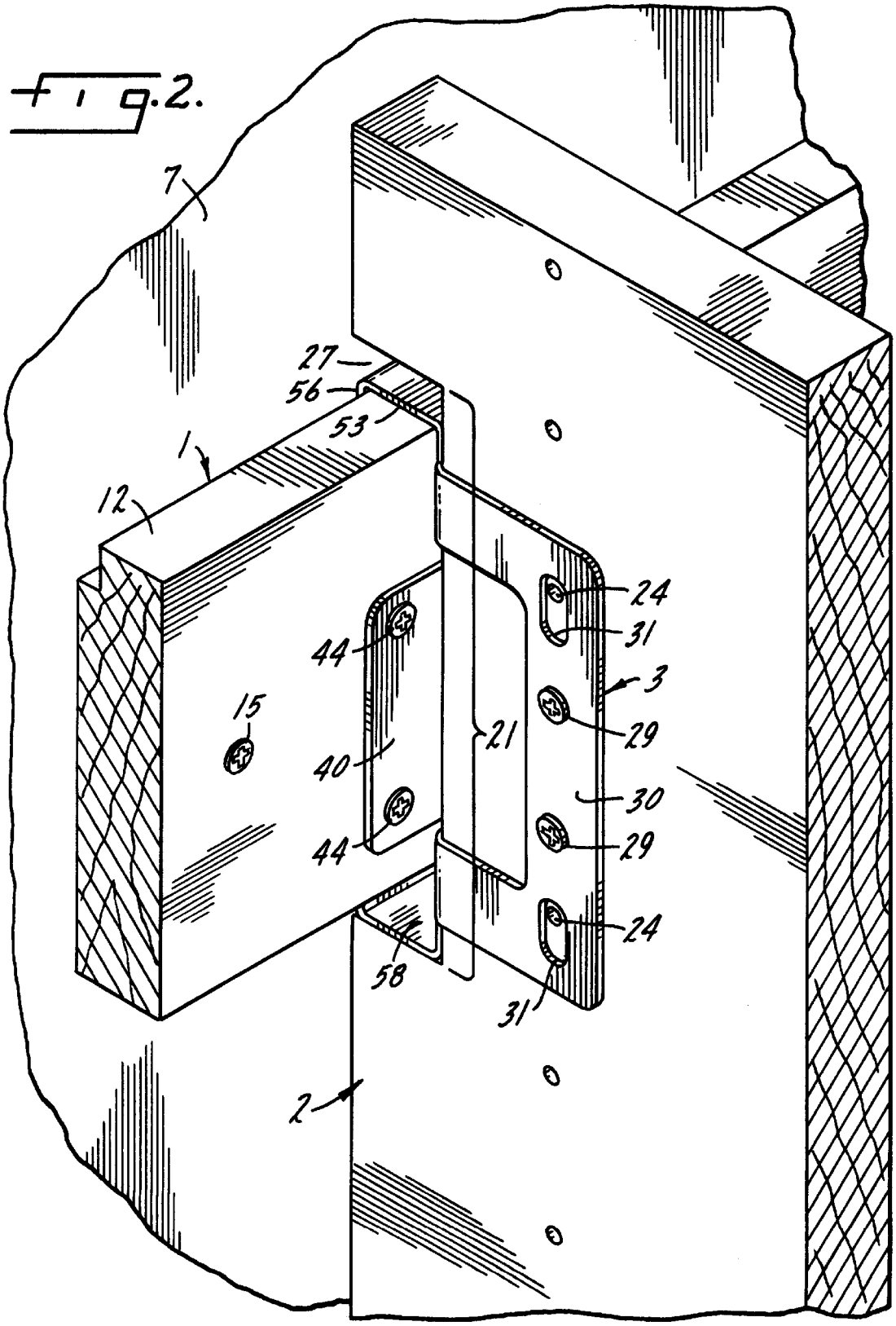
FIG. 2 a three-dimensional perspective view of the wall-mounted storage unit system of the present invention in its permanently-assembled form after vertical adjustments have been made to the vertical side panel.

Referring now to FIG. 2, the wall-mounted storage unit system of the present invention is shown in its permanently-assembled form after vertical adjustments have been made to the vertical side panel. For leveling purposes, an installer will usually adjust the vertical height of panel 2 after the mounting bracket 3 has been permanently secured in place upon the mounting rail 1. This quick procedure is performed by loosening mounting screws 35 within oval slots 31, shifting the panel 2 upwards with respect to the mounting bracket 3 such that a small upper gap 27 is now created between the upper hook 53 and the upper edge of the cutout section 21, and then re-tightening the mounting screws 35 to maintain the panel 2 in this new position. Panel 2 may then be permanently secured in place with respect to both the bracket 3 and rail 1 by inserting additional mounting screws 29 through round mounting holes 32 in the panel flange 30. Alternatively, the mounting screws 35 within oval slots 31 may be removed altogether (as shown in FIG. 2) as the additional mounting screws 29 secure the panel 2 to the mounting bracket 3.

It should be noted that by using one of screws 35 as a temporary holding screw, the other screw 35 may then be inserted in one round hole 32 and tightened, and the other screw 35 may be loosened and screwed into the other hole 32.

It should also be noted that even if the rail and panel are in the correct vertical relationship after the initial assembly as shown in FIG. 1, it is still desirable to place screws in round holes 32 to avoid the later possibility of vertical slippage.

Figure 3:
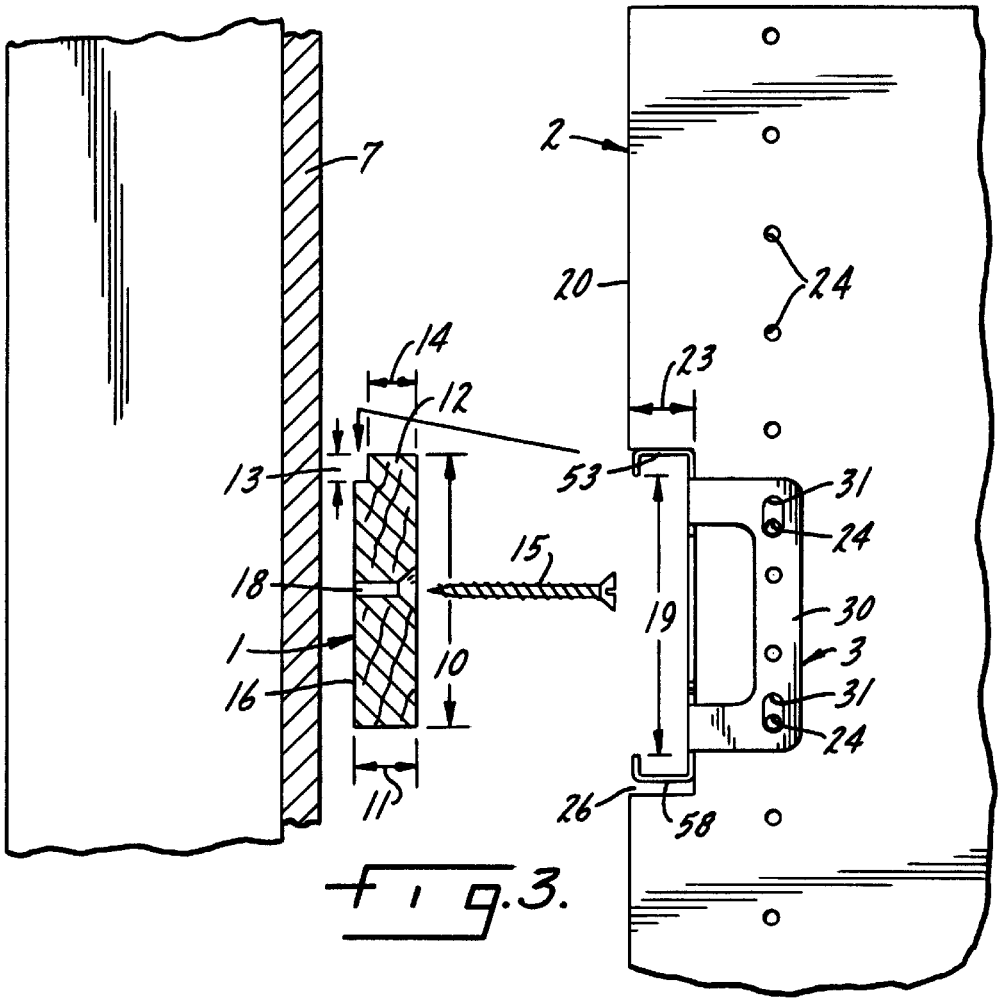
FIG. 3 is a side view of the mounting bracket and vertical side panel of the present invention shown in a detached position from a corresponding mounting rail and wall.

For more specific details, refer to FIG. 3. This figure presents a side view of the mounting rail 1, the vertical side panel 2 and the mounting bracket 3 of the present invention whereby the mounting rail 1 is yet unattached to a wall 7, and the mounting bracket 3 is unattached to the mounting rail 1. Mounting rail 1 is intended to be positioned against the wall 7 in a substantially horizontal fashion whereby rail screw 15 may be received by rail screw hole 18 to secure the mounting rail 1 in place. Once in place, the backside 16 of the mounting rail 1 will be firmly butted against the wall 7, and ledge segment 12 will be spaced a very short distance away from the wall 7.

Mounting rail 1 has associated with it a height 10 and a depth 11, and ledge segment 12 has associated with it a height 13 and a width 14. These very specific rail dimensions are intended to correspond with the dimensions of certain associated pieces of the mounting bracket 3. Specifically, hook member opening 19 is slightly larger than rail height 10 to allow the rail 1 to fit within the bracket 3. To ensure that the rear edge 20 of vertical side panel 2 butts against the wall 7 once the unit is assembled, the cutout depth 23 can be no deeper than the depth 11 of the rail 1. In addition, the internal dimensions of upper hook 53 are such that they comfortably accommodate the height 13 and width 14 of ledge segment 12 upon attachment.

FIG. 3 also shows the initial position (and, in some cases, the final position) of the mounting bracket 3 as it is first temporarily fastened to the vertical side panel 2. The upper hook 53 and lower hook 58 both nest within the cutout section 21 as the panel flange 30 is positioned against the side of vertical side panel 2. Specifically, upper hook 53 is placed against the upper edge of cutout section 21 while a small lower gap 26 is retained between lower hook 58 and the lower edge of cutout section 21. At this point, two of the pre-drilled bracket mounting holes 24 in the side of the panel 2 are in substantial alignment with the lower ends of oval mounting slots 31. Mounting screws 35 may then be used to temporarily secure the bracket 3 to the side of the panel 2 through the oval slots 31, as indicated in FIG. 4.

Figure 4:
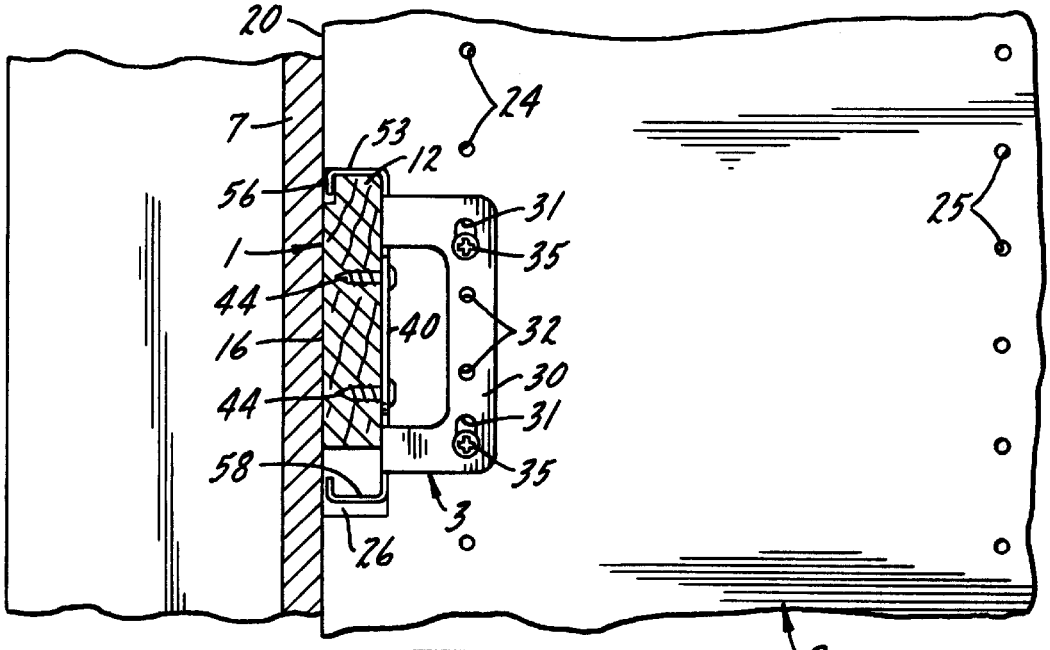
FIG. 4 is a side view of the mounting bracket, vertical panel and mounting rail of the present invention shown in their attached position with respect to a wall and before any vertical adjustments have been made to the vertical side panel.

FIG. 4 presents a side view of the wall-mounted storage unit of the preferred embodiment wherein the mounting rail 1, vertical side panel 2 and mounting bracket 3 are now arranged in their initially assembled positions. As the mounting bracket 3 already has been temporarily attached to the side of panel 2, the upper hook 53 is now placed over the mounting rail 1 whereby upper hook lip 56 engages a back side of ledge segment 12. This preferred construction ensures that both the rear edge 20 of vertical side panel 2 and mounting rail back side 16 are flush against the wall 7.

To ensure that adjacent panels are at the correct vertical height with respect to the mounting rail, i.e. shelves which extend from panel to panel will be horizontal, mounting screws 35 within oval slots 31 may be loosened slightly to allow a panel 2 to be shifted upwards with respect to its mounting bracket 3. When the proper vertical height is achieved, screws 35 may again be tightened to hold the panel 2 in place. Additional screws may then be inserted through round mounting holes 32 in panel flange 30 and into the side of panel 2 to permanently affix the panel 2 in its vertical position with respect to mounting bracket 3. Mounting holes 32 do not correspond to any of the predrilled holes 24. Thus, holes must be drilled in panel 2 which cooperate with round mounting screw holes 32 to accept these additional mounting screws.

Figure 5:
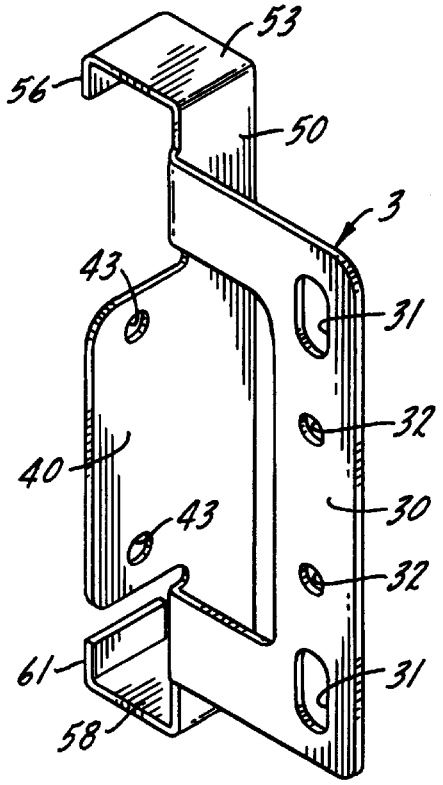
FIG. 5 is a three-dimensional perspective view of the mounting bracket of the present invention.
Figure 7:
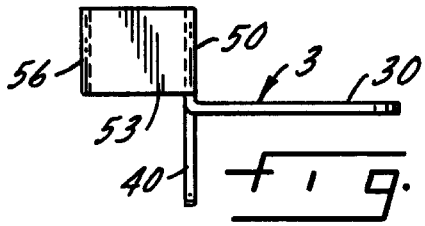
FIG. 7 top view of the mounting bracket.

Turning now to FIG. 5, a three-dimensional perspective view of the standard mounting bracket 3 of the present invention is shown. Such view exemplifies the "reversibility" of the mounting bracket 3 in that the top and bottom halves of this fixture are identical. That is, mounting bracket 3 may be positioned with either upper hook 53 or lower hook 58 acting as the upper-most support member which engages the mounting rail 1 and allows the vertical side panel 2 to be suspended therefrom. Mounting bracket 3 is comprised of a panel flange 30, rail flange 40 and hook member 50. Panel flange 30, which is mounted flush against a side of vertical side panel 2, includes oval mounting slots 31 and mounting holes 32. Rail flange 40, which is affixed to the face of the mounting rail 1, includes mounting holes 43. Hook member 50 is integrally formed with rail flange 40 and further includes upper hook 53, lower hook 58, upper hook lip 56 and lower hook lip 61. Hook member 50 is so designed as to be aligned with the thickness dimension of vertical side panel 2 and to fit within the cutout section 21.

The reversible aspect of mounting bracket 3 may be taken advantage of, for example, when constructing a unit having two side panels 2. Each bracket 3 would be attached to its respective panel 2 such that its panel flange 30 and rail flange 40 would be facing the "inside" of the unit—requiring each bracket 3 to be in a reversed position with respect to the other. Such construction ensures that the "outer" surfaces of the panels 2 are free from any protruding pieces.

Figure 6:
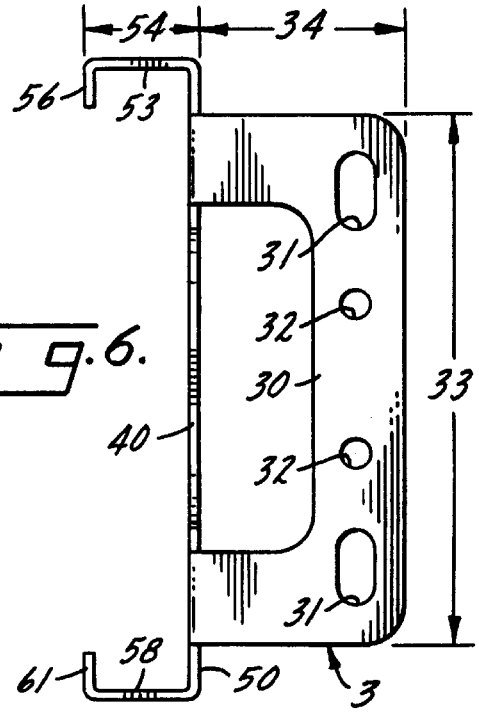
FIG. 6 is a side view of the mounting bracket.

FIG. 6 is a side view of the mounting bracket 3. The panel flange 30 of mounting bracket 3 has a height 33 and width 34 which are sufficiently sized to provide a high degree of stability to the mounting bracket 3 as it is affixed to a vertical side panel 2. Similarly, upper hook 53 has a length 54 which specifically accommodates the ledge segment 12 of the mounting rail 1. PIG. 6 illustrates the relatively thin edges of the rail flange 40, the hook member 50, the upper hook 53, the upper hook lip 56, the lower hook 58 and the lower hook lip 61. These elements are formed from metal plate stock which affords a great deal of strength to this relatively thin apparatus.

A top view of the mounting bracket 3 is seen in PIG. 7. Here, too, the relatively thin dimensions of both the panel flange 30 and rail flange 40 are shown. These elements are integrally formed with hook member 50 which, in turn, includes upper hook 53 and upper hook lip 56.

Figure 8:
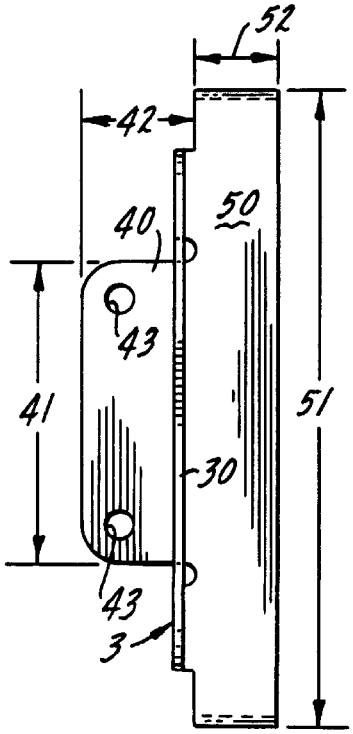
FIG. 8 is a front view of the mounting bracket.
Figure 9:
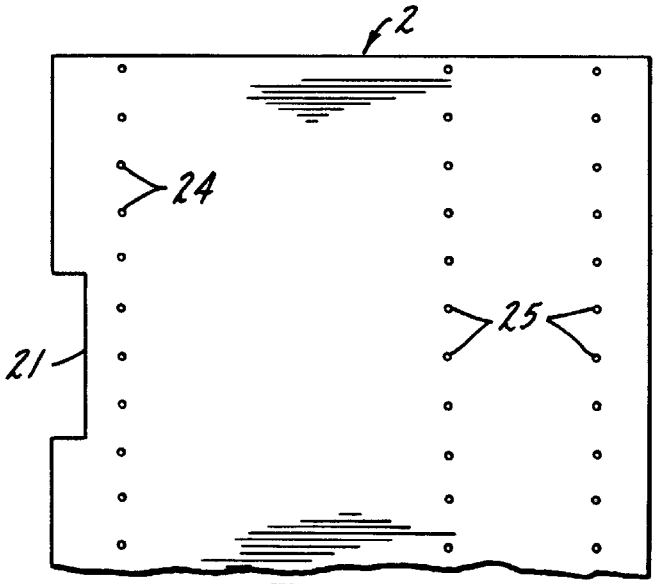
FIG. 9 is a side view of the vertical side panel of the present invention showing the approximate dimensions of its cutout section.

FIG. 8 is a front end view of the mounting bracket 3 of the present invention and shows the rail flange height 41, rail flange width 42, hook member height 51 and hook member width 52. Hook member 50 is so sized so as to fit loosely within the cutout section 21 of the vertical side panel 2. The function of rail flange 40 and its corresponding mounting holes 43 is to provide additional rigidity to the overall structure once the mounting bracket 3 and vertical side panel 2 are suspended from the mounting rail 1.

PIG. 9 shows a side view of the vertical side panel 2 of the present invention before it is attached to any other components. Cutout section 21, shown relatively near the top end of this vertical side panel 2, is located at a position whereby the utmost stability to the overall structure may be provided while still allowing an upward projection of the panel to approach, for example, the surface of a ceiling. As previously noted, bracket mounting holes 24 are provided as a means for permanently securing the mounting bracket 3 to the vertical side panel 2. Mounting holes 24 which are not used for this purpose, along with the horizontal member mounting holes 25, can be subsequently utilized to accept a variety of industry-standard storage fixtures including hooks, brackets, rods, shelves, etc.

It should be understood that the above-described embodiment is intended to illustrate, rather than limit, the invention and that numerous modifications could be made thereto without departing from the scope of the invention as defined by the appended claim. Indeed, any number of minor physical modifications could be made to the mounting rail 1, the vertical side panel 2 or even the mounting bracket 3 while still retaining the storage unit's ability to be interconnectively held together according to the preferred procedure.

While the present invention has been illustrated in some detail according to the preferred embodiment shown in the foregoing drawing and description, it will become apparent though skilled in the pertinent art that variations and equivalents may be made within the spirit and scope of that which has been expressly disclosed. Accordingly, it is intended that the scope of the invention be limited solely by the scope of the hereafter appended claims and not by any specific wording in the foregoing description.

I claim:

1. A reversible mounting bracket for suspending a storage unit directly from a horizontal rail secured to a generally vertically oriented base surface whereby the weight of the storage unit is transferred to the bracket, and then from the bracket to the horizontal rail, said mounting bracket including a C-shaped body section formed by a planar mid-section and a hook portion at each end of the planar mid-section, said C-shaped body section being vertically oriented and being substantially no wider than a cut-out in the edge of a wall panel which, in an assembled condition, butts against said generally vertically oriented base surface, a panel flange extending generally perpendicularly outwardly from one side of the planar mid-section of the C-shaped body section, a rail flange extending outwardly from said one side of the mid-section of the C-shaped body section and lying in the same plane as the mid-section of the C-shaped body section, whereby (a) said C-shaped body section lies within said cut-out in the edge of an associated wall panel when said panel flange is connected to said wall panel and said rail flange is connected to said rail, and (b) said bracket may be reversed, end for end, as desired, means for adjustably connecting the panel flange to a panel which is to be positioned with respect to said base surface whereby the height of the panel may be adjusted with respect to the mounting bracket, and means for connecting the rail flange, and thereby the mounting bracket, to a horizontal rail, whereby weight associated with the panel is transferred from the wall panel to the mounting bracket, and then to a horizontal rail.

2. The reversible mounting bracket of claim 1 further characterized in that the means for releasably connecting the panel flange to said panel includes at least one elongated fastener aperture in the panel flange adapted to receive a fastener capable of alternately securing and unsecuring the panel flange to a panel, and an aperture in the panel flange adapted to receive a fastener for securing the panel flange to a panel.

3. A wall-mounted storage unit system, said system including a horizontal rail, a wall panel, and a reversible mounting bracket for suspending the storage unit directly from the horizontal rail secured to a generally vertically oriented base surface whereby the weight of the storage unit is transferred to the bracket, and then from the bracket to the horizontal rail, said mounting bracket including a C-shaped body section formed by a planar-mid section a hook portion at each end of the planar mid-section, said C-shaped body section being vertically oriented and being substantially no wider than a cut-out in the edge of the wall panel which, in an assembled condition, butts against said generally vertically oriented base surface, a panel flange extending generally perpendicularly outwardly from one side of the planar mid-section of the C-shaped body section, a rail flange extending outwardly from said one side of the mid-section of the C-shaped body section and lying in the same plane as the mid-section of the C-shaped portion, whereby (a) said C-shaped body section lies within said cut-out in the edge of the wall panel when said panel flange is connected to said wall panel and said rail flange is connected to said rail, and (b) said bracket may be reversed, end for end, as desired, means for adjustably connecting the panel flange to the panel whereby the height of the panel may be adjusted with respect to the mounting bracket means for connecting the rail flange, and thereby the mounting bracket, to the horizontal rail, and means for securing the rail to the generally vertically oriented base surface, said cut-out having a height greater than the maximum vertical height of the C-shaped body section of the mounting bracket whereby relative movement can occur between the panel and the horizontal rail while the mounting bracket remains in contact with the upper supporting surface of the horizontal rail.

4. The wall-mounted storage unit system of claim 3 further characterized in that the means for releasably connecting the panel flange to said panel includes at least one elongated fastener aperture in the panel flange adapted to receive a fastener capable of alternately securing and unsecuring the panel flange to a panel, and an aperture in the panel flange adapted to receive a fastener for securing the panel flange to a panel.

* * * * *